United States Patent [19]

Ching et al.

[11] Patent Number: 4,563,819

[45] Date of Patent: Jan. 14, 1986

[54] ELLIPSOGRAPH CAPABLE OF DRAWING DOTTED LINE

[76] Inventors: Tien-Fu Ching, 14, Pei Chan Rd., Pei Shan Li, Hsi Chih City, Taipei Hsien, Taiwan, 221; Lung-Chiao Chou, 1, Alley 9, Lane 250, Cheng Kung Rd., Sec. 2, Nei Hu, Taipei, Taiwan, 114

[21] Appl. No.: 659,802

[22] Filed: Oct. 11, 1984

[51] Int. Cl.[4] ..... B43L 11/04

[52] U.S. Cl. ..... 33/30.4

[58] Field of Search ..... 33/30 R, 30 D, 31

[56] References Cited

U.S. PATENT DOCUMENTS 2,832,140 4/1958 Gaines ..... 33/39 A X

FOREIGN PATENT DOCUMENTS 245852 1/1926 United Kingdom ..... 33/30 D

*Primary Examiner*—Harry N. Haroian

*Attorney, Agent, or Firm*—Armstrong, Nikaido, Marmelstein & Kubovcik

[57] ABSTRACT

An improved ellipsograph capable of drawing dotted or dashed lines comprising a drawing unit with a small motor which drives a pen holder and two pull discs causing them to turn synchronously to draw ellipses in any shape from real circle to horizontal line by adjusting the radius of circumambulation of the pen and of the puller carriers, and a drawing control unit for controlling and selecting a dotted or a dashed line.

4 Claims, 27 Drawing Figures

ELLIPSOGRAPH CAPABLE OF DRAWING DOTTED LINE

BACKGROUND AND SUMMARY OF THE INVENTION

It takes time and effort to draw ellipses according to the elliptic formula. As is well known, a conventional elliptic compass can save much time required for drawing ellipses formularically but it is still troublesome and the precision is very low. Moreover, the ellipses drawn are limited to one specific vector. As a result, the elliptic plate still plays an important role in industrial drawing, though the elliptic plate is limited to a certain size.

In order to eliminate the above mentioned disadvantages of conventional elliptic devices, this invention employs a small motor to drive two discs one of which is a pen carrier and the other of which is a puller carrier and to make them turn synchronously. The puller acting as a base circle drawing control, pulls the pen carrier to draw an ellipse. While the elliptic vector is set by adjusting the radius of circumambulation of the pen carrier and the puller carrier, ellipses in dotted line can be drawn with the help of the drawing control unit.

The main object of this invention is to provide an improved ellipsograph which can, in easy operation, draw ellipses in any vectors from real circle to horizontal line without limitation in size as compared with a conventional elliptic compasses.

Another object of this invention is to provide an improved ellipsograph which can, in integral operation, draw precise ellipses without the errors typically made by conventional elliptic compasses.

This invention relates to an improved ellipsograph capable of a drawing a dotted or dashed line, especially one which, employing a small motor to drive two discs for pen and puller carriers to turn synchronously can, with the movement of the pen carrier pulled by the puller, draw ellipses of various vectors as set by adjusting the radius of circumambulation of the pen carrier and the puller carrier, and in dotted or dashed lines as controlled by a drawing control unit.

DETAILED DESCRIPTION

Figure 1A:
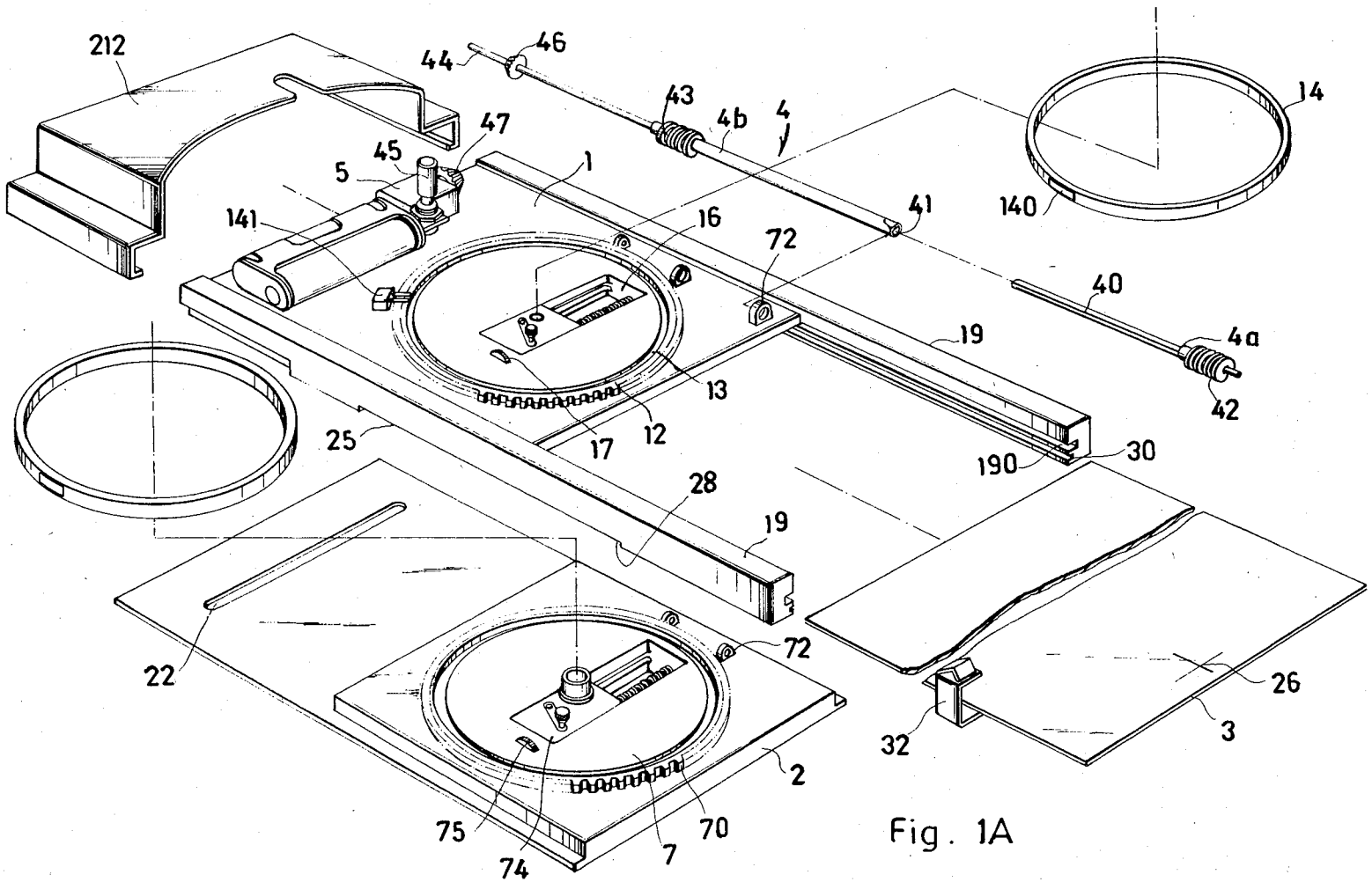
FIG. 1A is a vertical sectional view of the ellipse drawing unit of the improved ellipsograph of this invention.
Figure 1B:
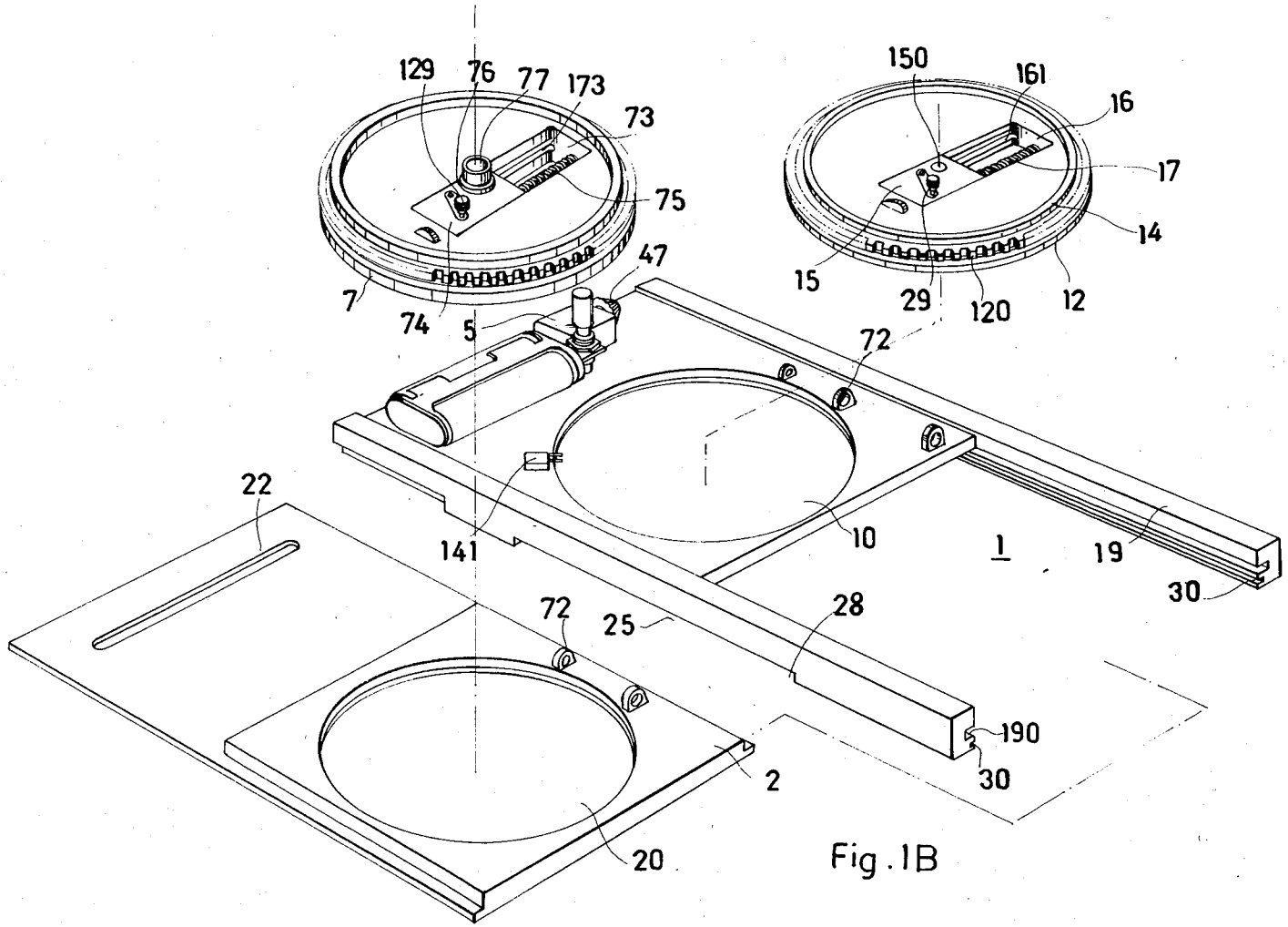
FIG. 1B is another vertical sectional view of the said drawing unit.
Figure 2B:
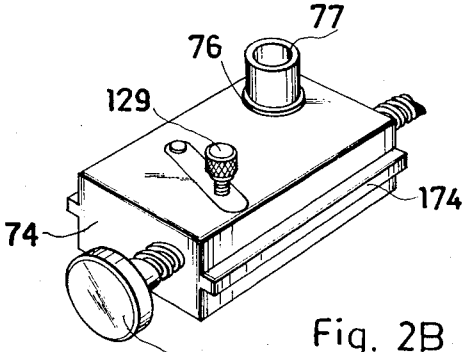
FIG. 2B is a vertical view of the adjusting unit for the movement of the pen carrier of the said ellipsograph.
Figure 2A:
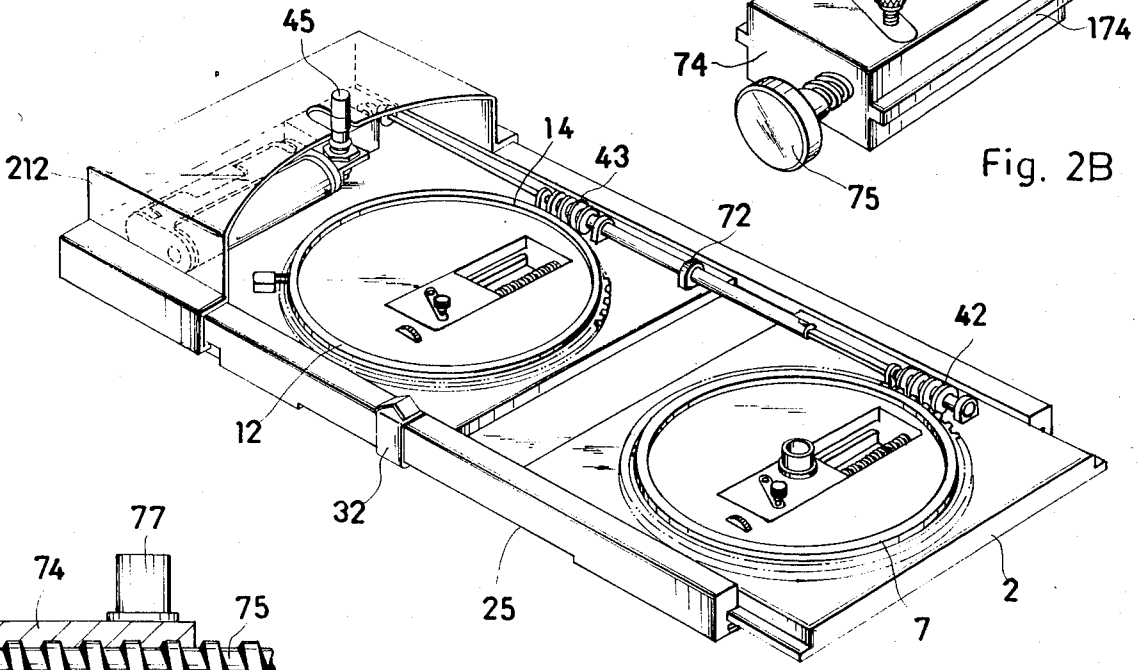
FIG. 2A is a vertical view of the said drawing unit, assembled.
Figure 2C:
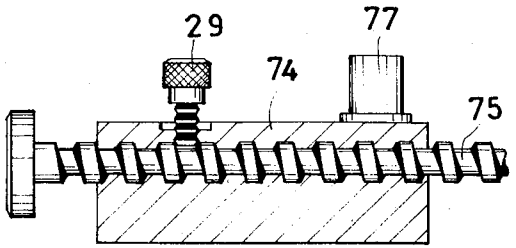
FIG. 2C is a sectional view of the adjusting unit as shown in FIG. 2B.
Figure 3A:
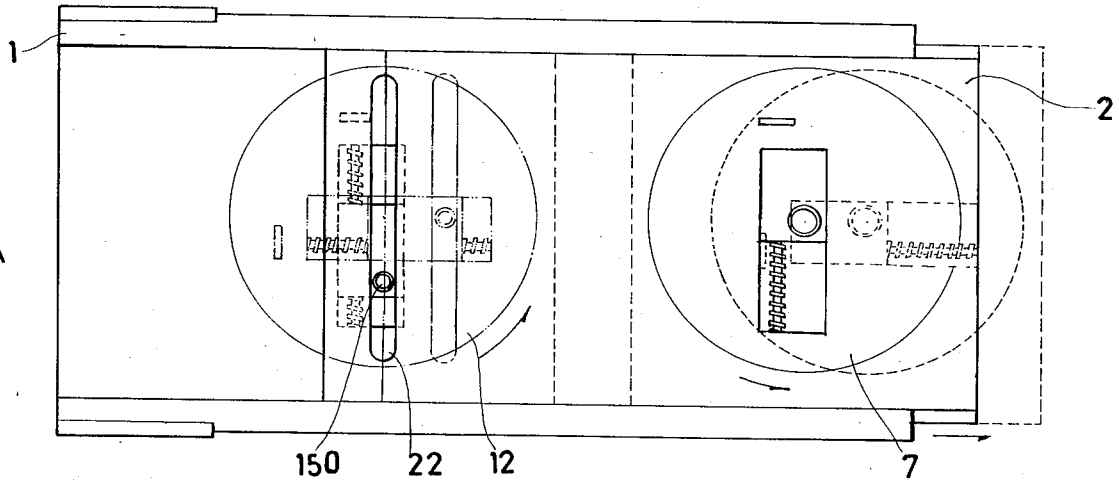
FIG. 3A illustrates the reciprocating linear movement of the pen carrier disc pulled by the puller of the said ellipsograph.
Figure 3B:
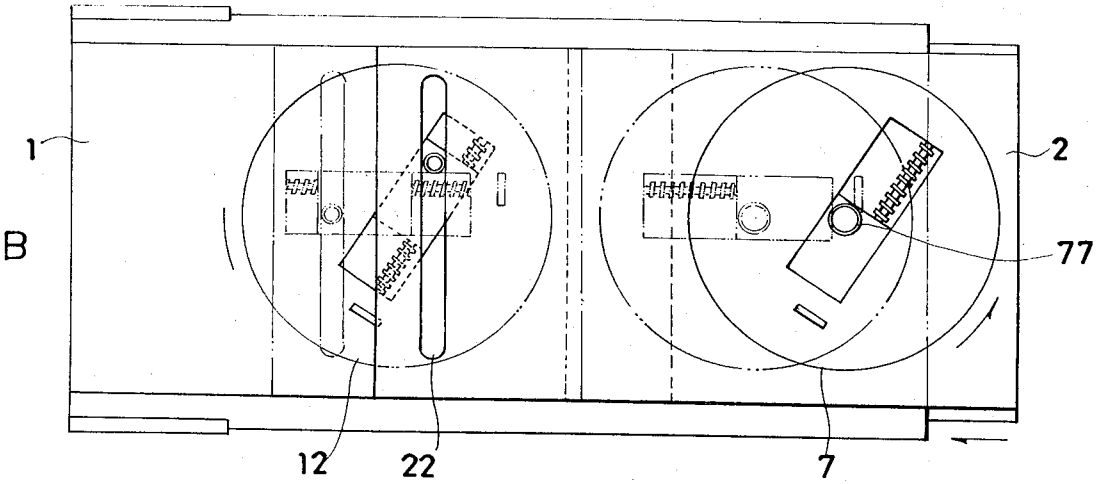
FIG. 3B further illustrates the reciprocating linear movement of the pen carrier disc pulled by the puller of the said ellipsograph.
Figure 4A:
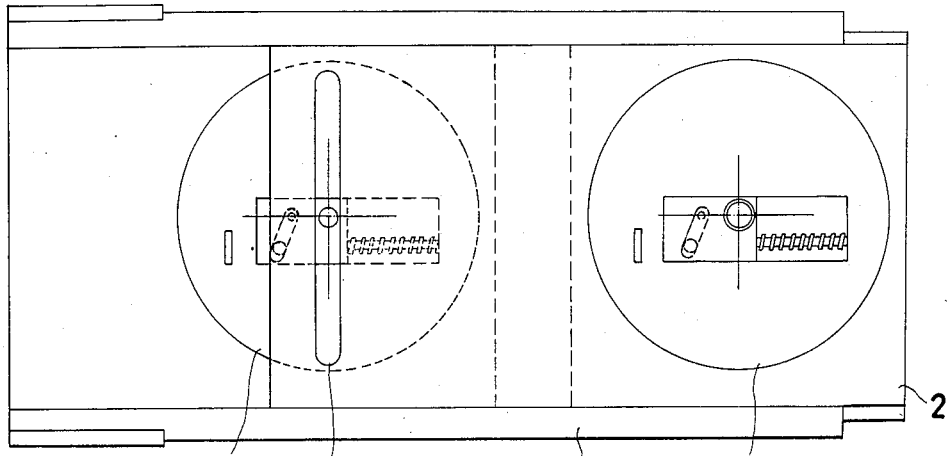
FIG. 4A is a vertical view of the ellipsograph.
Figure 4B:
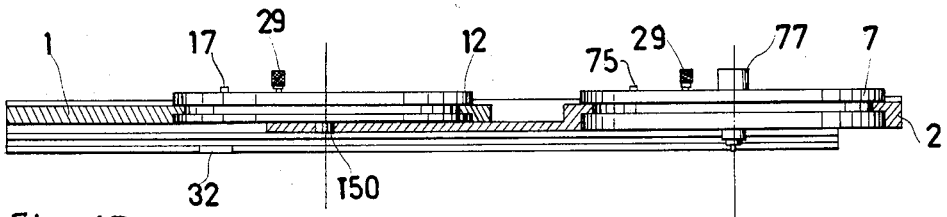
FIG. 4B is a schematic view of the point formed when the pen carrier and the carrier puller are respectively situated at the center of the disc.
Figure 4C:
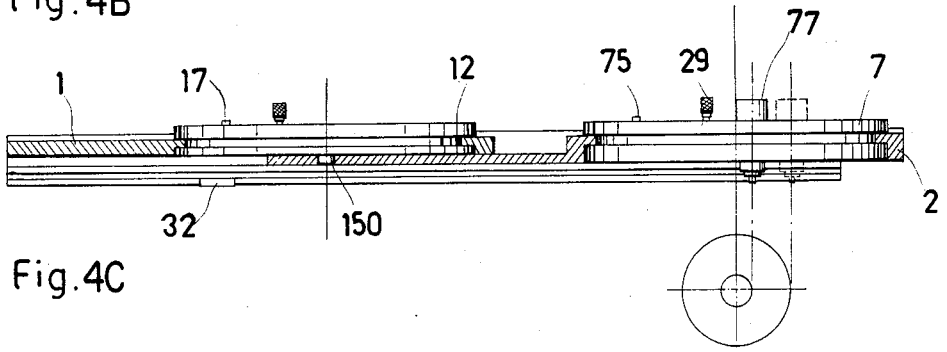
FIG. 4C is a schematic view of the circle formed when the puller carrier is situated at the disc center while the pen carrier is away from the disc center.
Figure 4D:
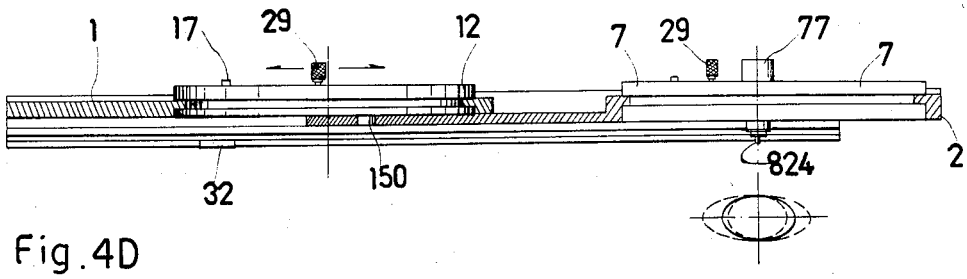
FIG. 4D is a schematic view of the ellipse formed when the puller and the pen carriers are adjusted off their disc centers.

Referring now to the drawings, the structure and function of this invention is described as follows:

As shown in FIGS. 1A and 1B, the improved ellipsograph of this invention comprises a base frame 1, a slide plate 2, a support plate 3, a transmission rod 4 and a small motor 5. The support piece of the base frame 1 has a round opening 10 for fitting the puller carrier disc 12. The disc 12 has a groove 13 at the perimeter for setting a ring conductor 14. The disc 12 also has a slot 16 in the center for fitting the puller carrier 15. The puller carrier 15 has long projections at both sides to be slidably fitted on the sliding rails 161 on the walls of the slot 16. An adjusting screw rod 17 with a knurled knob at one end is fitted horizontally in a threaded hole in the puller carrier 15 and into holes in the slot walls is provided for rough adjusting and an adjuster with a microadjusting control 29 fitted vertically from the surface of the puller carrier 15 to the thread of the screw rod 17 is provided for fine adjusting. The slide plate 2 has a round opening 20 at the front part for fitting the pen carrier disc 7 like the puller carrier 15. The disc 7 has a slot 73 at the center for fitting the pen carrier 74. With the long projections 174 at both sides of the pen carrier 74 and the rails 173 on the walls of the slot 73, the pen carrier 74 is slidably fitted in the slot 73. An adjusting screw rod 75 and a micro-adjusting control 129 are provided in the same way as those for the puller carrier 15 for rough and fine adjusting as shown in FIG. 2B. Differently, the pen carrier 74 has a round recess 76 at the top for fitting the pen holder 77 while the puller carrier 15 has a pulling rod 150 protruding from the carrier base for pulling with the transverse groove 22 at the rear end of the slide plate 2. As shown in FIGS. 1A and 2A, the transmission rod 4 consists of a front section 4*a* having a worm wheel 42 in mesh with the teeth 70 of the pen carrier disk 7 and a rear section 4*b* having a worm wheel 43 in mesh with the teeth 120 of the puller carrier disk 12. The front section 4*a* is fitted in the rear section 4*b* with the external cut-off surface 40 of the front section 4*a* contacting the internal cut-off surface 41 of the rear section 4*b* so that the movement can be transmitted from the rear section 4*b* to the front section 4*a*. The slide plate 2 is fitted in the upper grooves 190 made in the inside of the two side pieces 19 of the base frame 1 while the support plate 3 is fitted in the lower grooves 30. A U-piece 32 is fitted and held in the guide groove 25 of the side piece 19. The support plate 3 has a cross coordinate 26 at the top surface to be used as a control in setting the major and minor axis of the ellipse to be drawn. Specifically, when the U-piece 32 of the support plate 3 is moved to the front end 28, (FIG. 1A) the origin of the coordinates 26 is in alignment with the center of the pen carrier disc 7. So a desired ellipse can be drawn only by aligning the major and minor axis with the coordinates. But in use, care must be taken to get the support plate 3 returned to its original position after the major and minor axis are set lest the operation of the disc 7 be hindered. The transmission shaft 4 has a bevel gear 46 at the rear end being in mesh with another bevel gear 47 of the motor 5, with an on and off switch 45 and two worm wheels 42, 43 respectively in mesh with the teeth 70, and 120 of the pen and puller carrier discs 7, 12, and is fixed to the base frame 1 by means of several fasteners 72. As specifically shown in FIG. 3A and FIG. 3B, when the switch 45 is pressed, the motor 5 is started to drive the two discs 12, 7 to turn synchronously. The puller carrier 15 circumambulates with the turning of the disc 7 and, through the puller 150 of which one end is movably fixed in the transverse groove 22 at the rear of the slide plate 2, and the slide plate 2 with the pen carrier 74 on it reciprocates synchronously with the circumambulating of the puller carrier 15. The pen carrier 74 located eccentrically on the disc 7 circumambulates with the turning of the disc 7 and simultaneously reciprocates with the puller 150. As a result, the pen carrier 74 circumambulates elliptically. Since the length of the major axis of the ellipse so drawn depends on the distance which the slide plate 2 moves as it reciprocates and since the distance of reciprocation depends on the the radius of the circle described by the pulling rod 150, the major axis of the ellipse depends on the position of the pulling or. Namely, the length of the major axis can be set by adjusting the location of the pulling rod 150 with the adjusting device 17 of the puller carrier 15. Meanwhile, since the eccentricity of the pen carrier 74 determines the length of minor axis and the vector of the ellipse, the length of the minor axis and the vector can be set by adjusting the eccentricity of the pen carrier 74 with the adjusting device 75 as shown in FIG. 4D. As shown in FIG. 4C, when the puller 150 is put in the center of the disc 12 with the pen carrier 74 set eccentrically, a real circle will be drawn. As shown in FIG. 4D, when the puller 150 and the pen carrier 74 are set eccentrically an ellipse will be drawn. And with the eccentricity, many different vectors can be set and used for drawing various ellipses.

Figure 5:
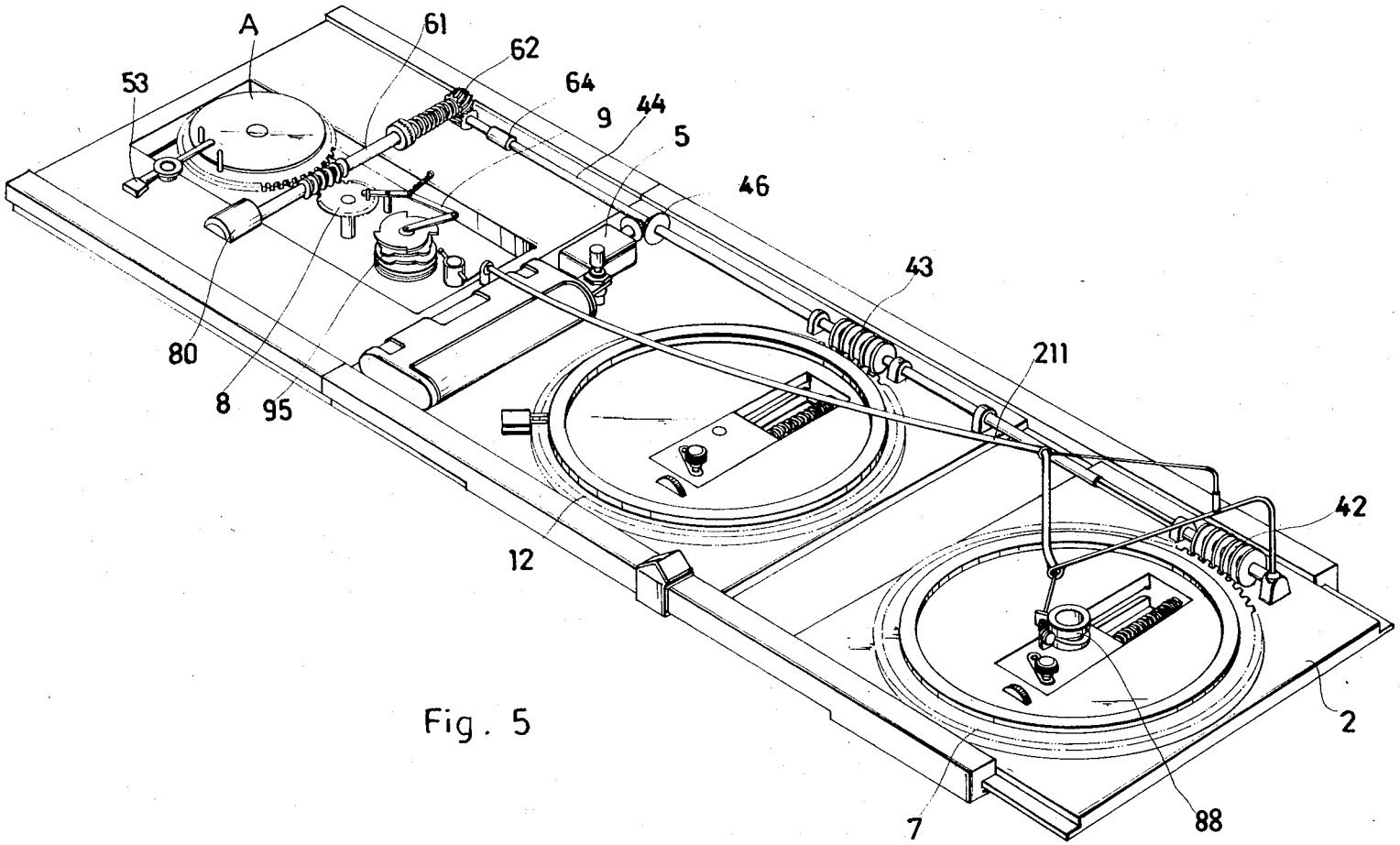
FIG. 5 is a vertical view of the ellipse drawing unit and the drawing control unit of the said ellipsograph.
Figures 6A, 6B:
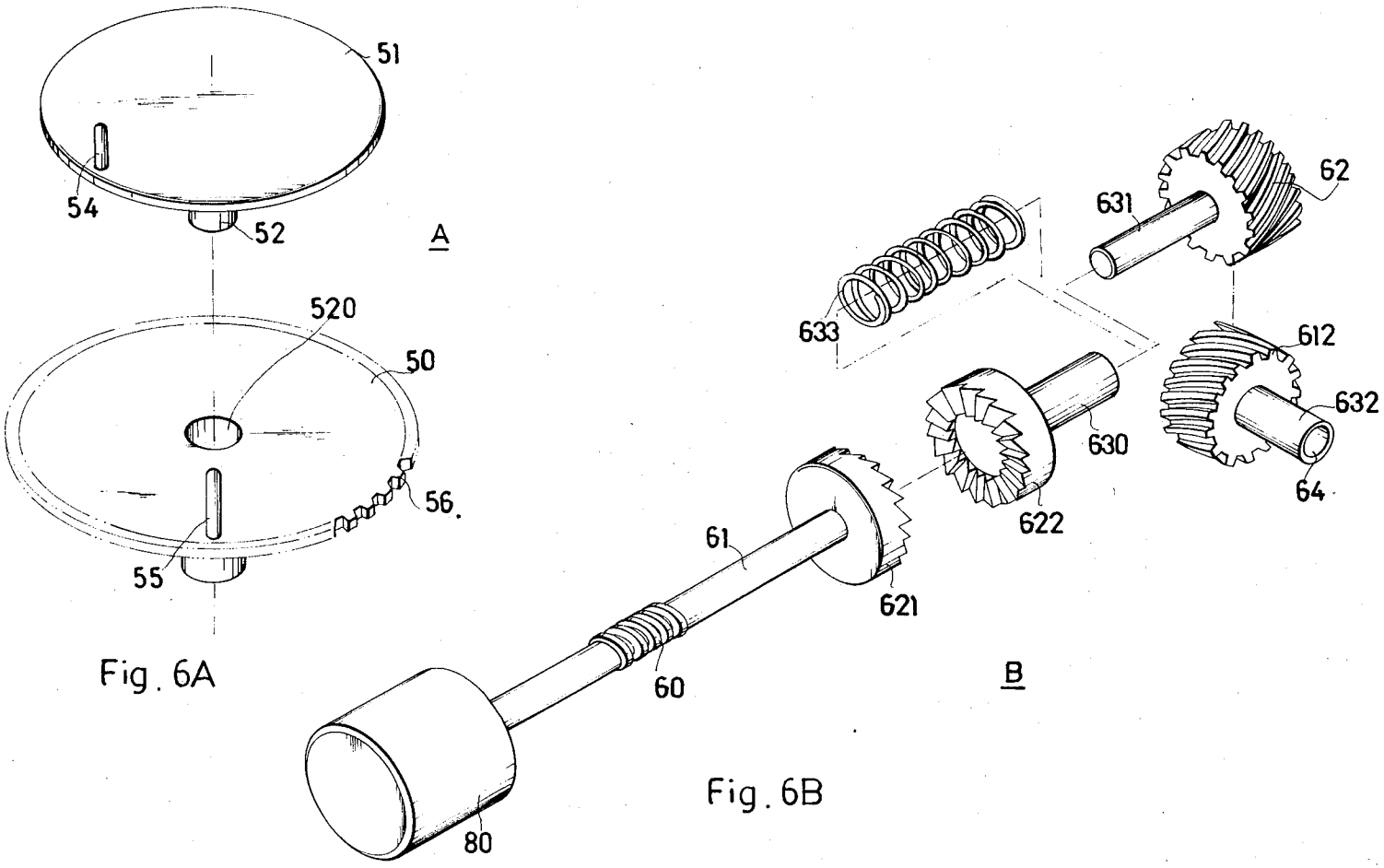
FIG. 6A is a sectional view of the switch controller of the drawing control unit of the said ellipsograph.
FIG. 6B is a sectional view of the transmission shaft of the said drawing control unit.
Figure 6D:
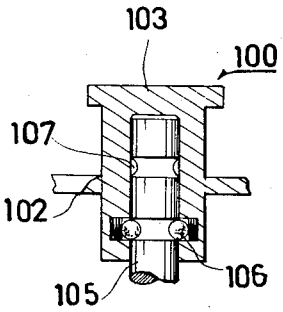
FIG. 6D is a sectional view of the lever puller of the said drawing control unit.
Figure 6C:
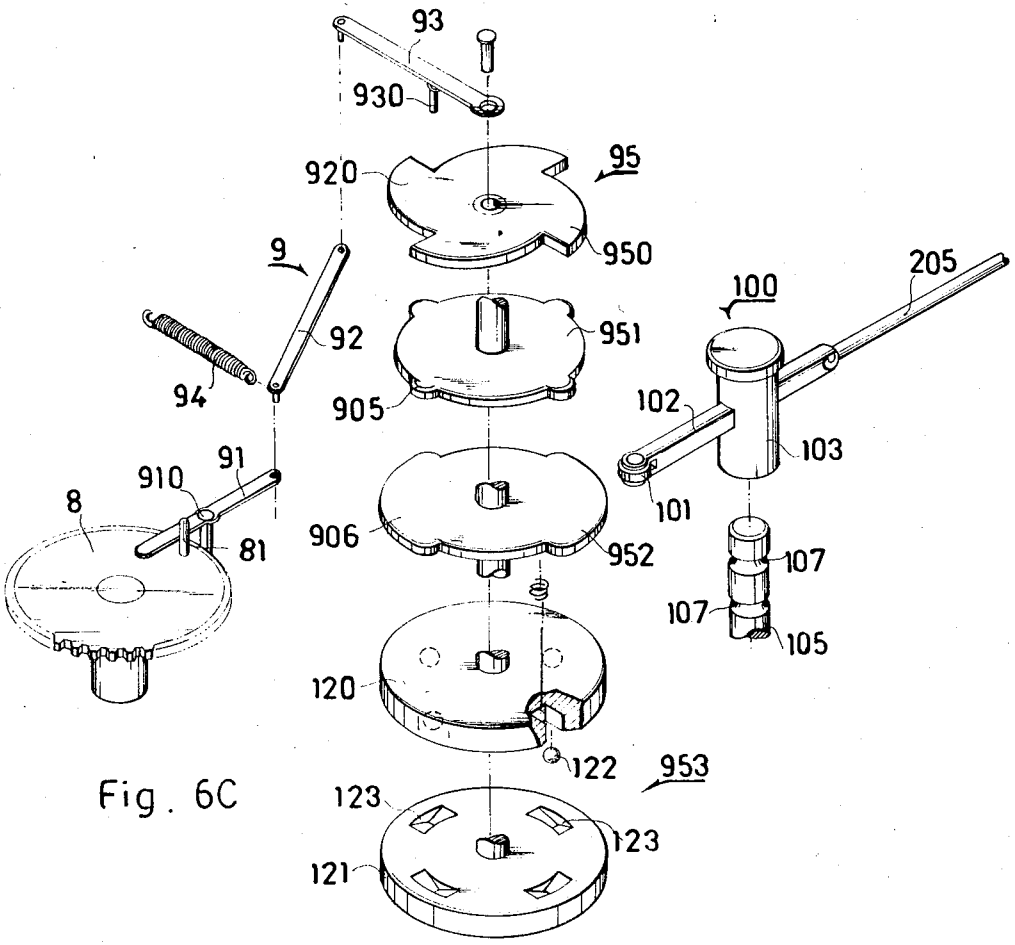
FIG. 6C is a sectional view of the drawing control gear, pivoted link, drawing control cam and lever puller of the said drawing control unit.
Figure 6I:
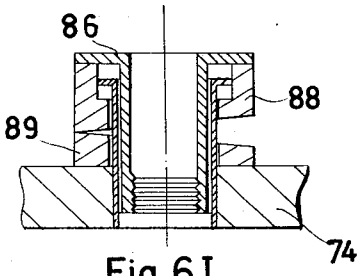
FIG. 6I illustrates the movement of the control drawing pen carrier of the said drawing control unit as illustrated in FIG. 6G.
Figure 6H:
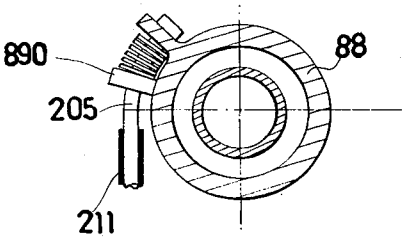
FIG. 6H illustrates the movement of the control drawing pen carrier of the said drawing control unit as illustrated in FIG. 6F.
Figure 6G:
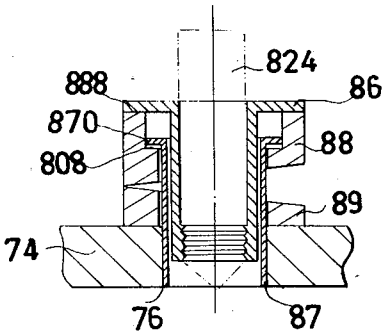
FIG. 6G is a sagital section of the control drawing pen carrier.
Figure 6F:
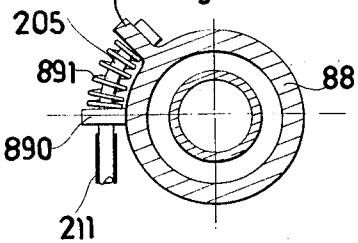
FIG. 6F is a horizontal section of the control drawing pen carrier of the said drawing control unit.
Figure 6E:
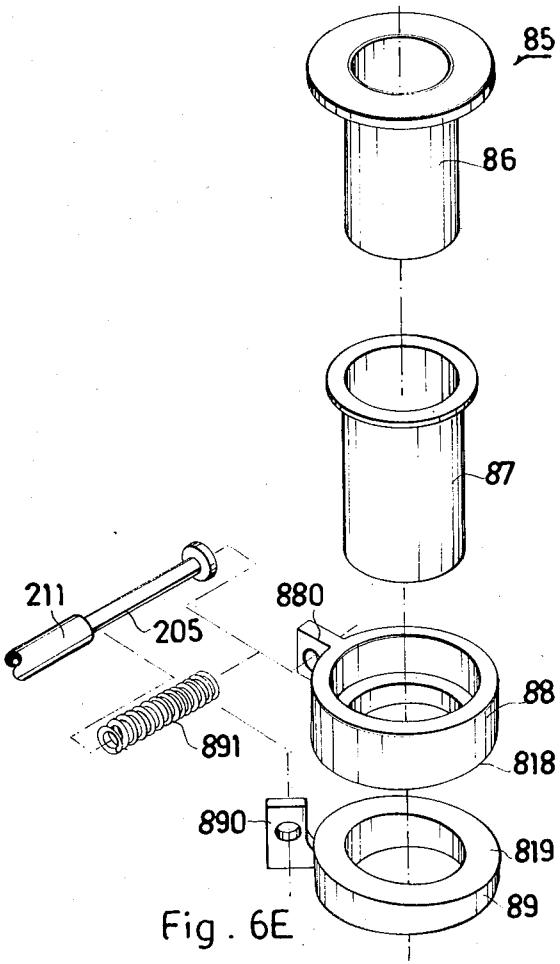
FIG. 6E is a sectional view of the control drawing pen carrier of the said drawing control unit.
Figure 7A:
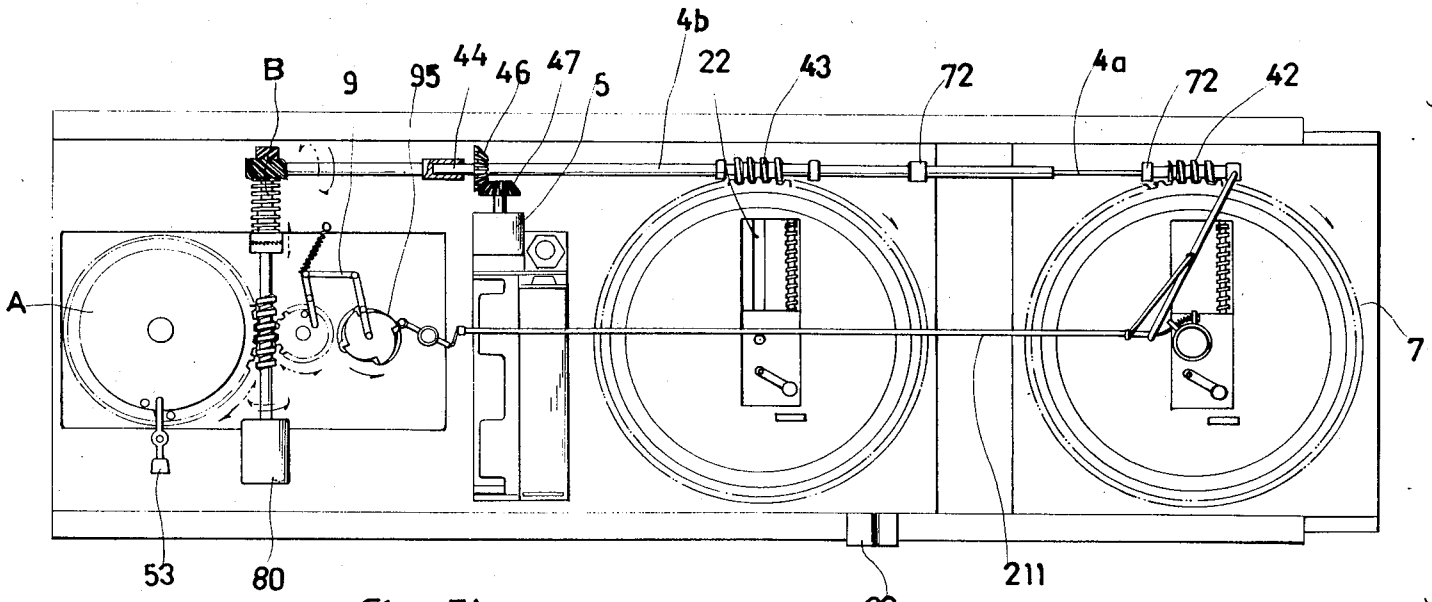
FIG. 7A illustrates the transmission of the ellipse drawing unit and the drawing control unit of the said ellipsograph.
Figure 7B:
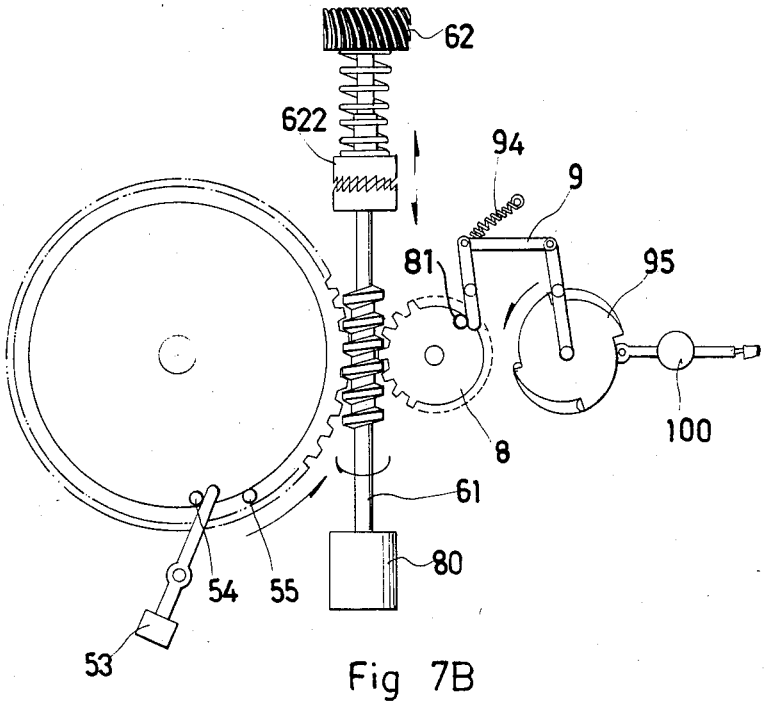
FIG. 7B illustrates the transmission of the said drawing control unit when the motor turns left.
Figure 7C:
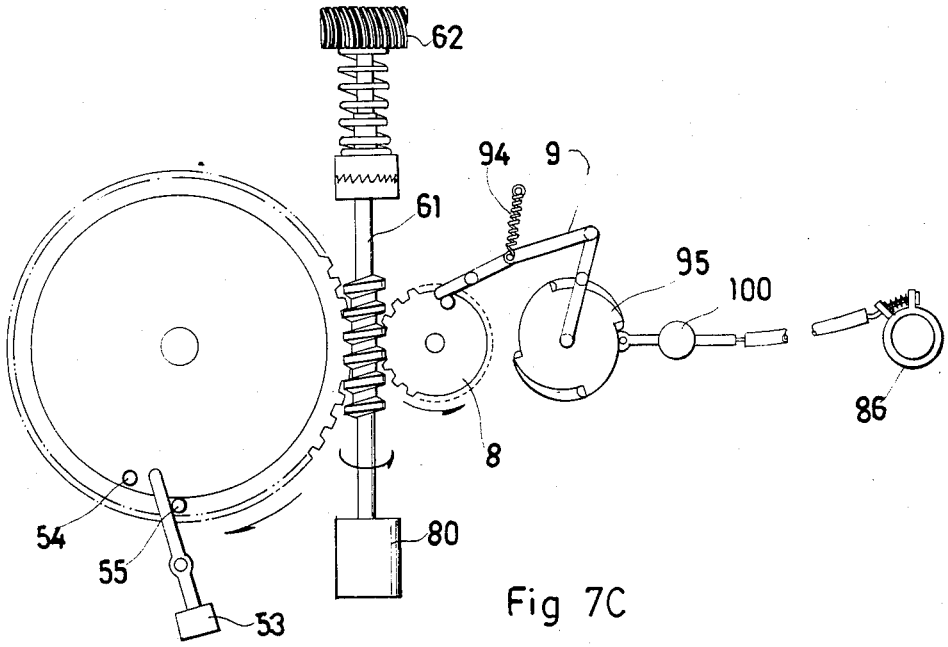
FIG. 7C illustrates the transmission of the said drawing control unit when the motor turns right.
Figure 7D:
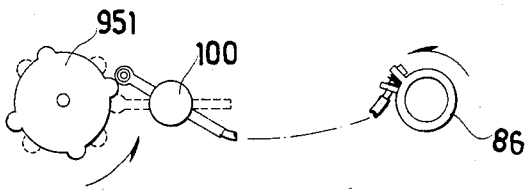
FIG. 7D illustrates the relations of movement between the cam and the lever puller of the drawing control unit and the pen carrier of the drawing control unit of the said ellipsograph.
Figure 7E:
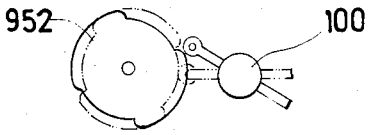
FIG. 7E illustrates the relations of movement between the I-shaped cam and lever puller of the drawing control unit and pen carrier of the said drawing control unit.
Figure 7F:
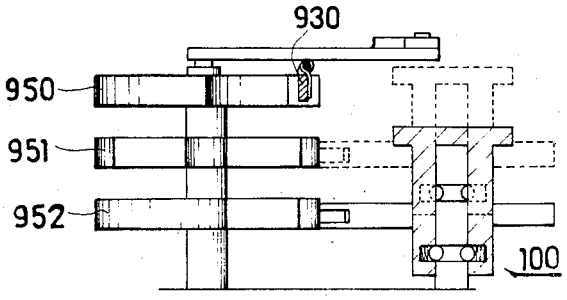
FIG. 7F illustrates the related movement of the adjusting and drawing control cam of the lever puller of the said drawing control unit.

As shown in FIGS. 5, and 6A–H the drawing control unit consists of a set of switch control discs A, a set of transmission shafts B, a drawing control gear 8, a set of pivoted links, a set of drawing control cams 95, a lever puller 100 and a drawing pen holder 85. The set of switch control discs A as shown in FIG. 6A includes two discs, one larger 50 and one smaller 51. The larger disk 50 has a central hole 520 in which the central stub arbor 52 is fitted. The discs 50, 51 have vertical stubs 54, 55 near the rim respectively. The larger disc 50 has teeth 56 at the perimeter to be engaged by the worm wheel 60 of the transmission shaft B. As shown in FIG. 6B, the transmission shaft B consists of a driving shaft 61 and three driven gear shafts 630, 631, 632. The driving shaft 61 is connected to the motor 80 at the front end and has a worm wheel 60 in the middle and a ratchet wheel 621 at the rear end. The ratchet wheel 621 keeps in mesh with the relative ratchet wheel 622 at the front end of the first driven gear shaft 630. The rear end of the first driven gear shaft 630 is fitted in the front end of the second driven gear shaft 631 and a spring 633 is fitted over the shaft part between the two wheels. The second driven shaft 631 has a transmission gear 62 at the rear end. The transmission gear 62 keeps in mesh with another transmission gear 612 at the front end of the third driven gear shaft 632. The rear end part 64 of the third driven shaft 632 is fitted over the rear end part 44 of the transmission rod 4 so that the driving shaft 61 can drive the discs 12, 7 indirectly. The transmission is clearly shown in FIG. 5. As shown in FIG. 6C, the drawing control unit consists of a drawing control gear 8, a pivoted link 9, a drawing control cam 95 and a lever puller 100. The drawing control gear 8 has a stub 81 on the top and engages with the worm wheel 60 of the transmission shaft B. The link 9 consists of three sections 91, 92, 93 pivoted together. A spring 94 is provided at the pivot of the first section 91 and the second section 92. The front end of the first section 91 extends to the top of the drawing control gear 8 and has a supporting point 910 in the middle. The third section 93 is pivoted to the center of the ratchet gear 950 on the drawing control cam 95. Except the ratchet gear 950 on the top, there is a four-lobe cam 951, an I-cam 952 and a set of positioning control discs 953 under the drawing control cam 95. The positioning control discs 953 include a rotary disc 120 and a support disc 121 overlapping each other. The rotary disc 120 has a spring-supported ball 122 on the bottom. The support disc 121 has four angular grooves 123 made on the top along the circle where the spring-supported ball circumambulates. The angular grooves 123 are in alignment with the lobes 905 and the ratchet corners so that under the control of the positioning control disc 953 the ratchet corners and lobes will rotate at 90° intervals. The lever puller 100 as shown in FIG. 6C consists of a lever 102 with a pulley 101, a support socket 103 fitted in the middle part of the lever 102 over a sectional fixing arbor 105. The support socket 103 has a spring supported ball 106 in the internal wall as shown in FIG. 6D. The sectional fixing arbor 105 has two ring grooves 107 as shown in FIG. 6E. The control drawing pen holder 85 consists of a holder body 86, a fixing socket 87, two ring sockets 88, 89 with relatively oblique planes 818, 819, a pull wire 205 connected to the lever puller 100. As shown in FIGS. 6F, and 6G the ring sockets 88, 89 are joined together by means of a pull wire 205 through the lugs 880, 890 of themselves with a spring 891 fitted over the wire 205 between the two lugs, and with two oblique planes overlapping each other relatively. The fixing socket 87 is fitted in the two ring sockets 88, 89 and fixed to the round recess 76 of the pen carrier 74. The holder body 86 is fitted in the fixing socket 87 with the top flange 870 of the fixing socket 87 fitted in the opening 808 of the ring socket 88 so as to control the movement of the ring sockets 88, 89. The normal position of the ring sockets 88, 89 is as shown in FIG. 6F. The two oblique planes contacting each other at the end point form an angle. In this case, the pen holder body 80 is raised by the top 888 of the ring socket 88. So in normal state, the pen nib of the pen 824 screwed in the pen holder body 86 does not touch the paper. But when the ring sockets 88, 89 are pulled to turn by the pull wire 205 through the lugs 880, 890, as indicated in FIGS. 6H and 6I the contact area of the oblique planes 818, 819 increases and the pen holder body 86 and the pen 824 lower with the upper ring socket 880 until the pen nib touches the paper. When the pull ceases, the upper ring socket 88 and the pen holder body 86 and the pen 824 return to the original position. From the above and from the illustration in FIG. 7A, it is clear that the drawing control unit of this invention employs the pull wire to control the up and down movement of the pen holder body 86 resulting in intermittent touches of the pen 824 on the paper. Meanwhile, with the controlled intermittent rotation of the discs 7, 12, the ellipse will be drawn in dotted or dashed line, depending on the time of pull under control. As shown in FIG. 7A, the motor 80 can be started to drive the driving shaft 61, the switch control disc A and the drawing control gear 8 directly and the two discs 12, 7 indirectly. The stubs 54, 55 on the switch control discs A driven by the driving shaft 61 will, with the rotating of the discs 12, 7 in different directions, push the switch control lever 53 alternately to control the rotating directions of the motor 80. The time of changing direction is decided by the circular measure of the switch control lever 53 between the two stubs 54, 55. So the alternating time can be controlled by adjusting the circular measure. The left and right turn of the motor 80 is mainly to cause the pen nib to lower on to the paper for working as well as to make the discs 7, 12 under the control of the ratchet gears 621, 622 to remove intermittently in conformity with the intermittent work of the pen 824. As shown in FIGS. 6C and 7B, when the motor turns anticlockwise, the stub 81 on the top of the drawing control gear 8 pushes clockwise the first section 91 of the link 9 and makes it to exert its leverage with the support of the supporting point 910 and the force of the spring 94. Meanwhile, the second and third sections 92, 93 are pulled to extend outward and by using the stub 930 with which the third section 93 is pivoted, to hit the ratchet corner 920 of the ratchet wheel 950 and make the wheel 950 to turn counterclockwise for 90°, (The 90° turn is guided by the positioning control disc.) At the same time, the rim of the four-lobe cam 951 or the I-cam 952 beneath the ratchet wheel 950 and turning synchronously with the ratchet wheel 95 keeps in touch with the pulley 101 of the lever puller 100 and when the lobe 905 or 906 touches the pulley 101, the lever 102 with the pulley 101, swings outward with the support of the supporting point 103 and causes the wire 205 fixed to the other end of the lever 102 to pull the ring sockets 88, 89 of the drawing pen holder to turn and to make the pen nib to lower onto the paper for working as said above. Dotted or dashed line will be resulted from the contact of the pulley 101 of the lever puller 100 with the four-lobe cam 951 or the I-cam 952 as shown in FIG. 7F. The four-lobe cam 951 has four lobes 905 arranged at equal intervals of 90° and designed to cope with the four ratchet corners 920 of the ratchet gear 950 and the four positioning grooves 123 of the positioning control disc. When the ratchet corner 920 is hit once by the link 9, the lobe 905 of the four-lobe cam 951 touches the pulley 101 once and the pen nib reciprocates once. The short contact of the lobe 905 with the pulley 101 results in a dot drawn by the pen nib while the longer contact of the lobe 906 of the I-cam 952 with the pulley 101 results in a dash drawn by the same. When the motor 80 changes from anticlockwise turn to clockwise turn, the stub 81 on the drawing control gear 8 pushes the link 9 outward and makes the second and third sections 92, 93 of the link 9 extend inward, and the stub 930 at the end of the third section 93 moves against the ratchet corner 920 of the ratchet gear 950 without hitting and turning the ratchet gear 950 and causing the pen 824 to lower to work. Accordingly the continuous changes of turning direction of the motor 80 causes the pen 824 to draw intermittently. In addition, the change of direction of the motor 80 also throws the set of ratchet gears 621, 622 into or out of drive and leads to intermittent turns of the discs 7, 12. This in combination with the intermittent movement of the pen 824 achieves the drawing of dotted or dashed line. To draw dotted line, the pulley 101 of the lever puller 100 is set to keep in touch with the four-lobe gear 951. When the motor 80 turns clockwise, the set of the four-lobe cam 95 is indirectly driven to turn counterclockwise for 90°. The lever pulley 101 is pushed away by one of the lobes 905 of the cam 951 during the 90° turn and the wire 205 fixed to the other end of the lever 102 pulls the pen holder to cause the pen 824 to lower. Since the touch is very short and the pen rises quickly with the force of the spring fitted over the wire 205 between the two lugs 880, 890, the pen 824 only draw a dot on the paper. However, the change of direction of the motor 80 causes the two ratchet gears 622, 623 to disengage and the transmission is interrupted. The discs 7, 12 are no longer driven by the motor 80 and stops turning. When the motor 80 turns right the stub 930 of the link 9 can not pull the cam set 95 and the drawing pen holder stops working. When the motor reverses, the ratchet gears 622, 623 engage with each other and the discs 7, 12 are driven to turn. Accordingly, the continuous change of direction of the motor 80 causes the intermittent work of the pen 824. This in combination with the intermittent turns of the discs 7, 12 makes the pen 824 to draw dotted line. To draw dashed line, the pulley 101 of the lever puller 100 is set to keep in touch with the I-cam 952. Unlike the procedure of drawing dotted line, when the I-cam 952 is driven to turn counterclockwise for 90°, the pulley 101 will not return to its normal position until it slides off the lobe 906. So the pen 824 driven by the discs 7, 12 is lowered to draw ellipse in dashed line. From the above, the drawing control unit of this invention is designed to draw ellipses in dotted or dashed line and to make up the deficiency of conventional ellipsographs. As shown in FIG. 5 this independent separable unit can be installed at the rear of an ellipsograph for use when necessary. It must be noted that the pen holder 77 for drawing solid line should be changed to the pen holder 86 for drawing dotted or dashed line because their structure and function are different. Besides, this invention employs two types of motor 5, 80.

The ring conductor 14 on the discs 7, 12 of this invention have nonconductors 140 set around them. So when a conductor pin 141 installed on the peripheral wall keeps in touch with the ring conductor 14, it is on. And when the conductor pin 141 keeps in touch with the nonconductor 14, it is off. A snap-in cover 212 is provided to cover the motor and the transmission system to give a good-looking appearance.

From the above, it is clear that the ellipsograph capable of drawing dotted or dashed line of this invention is very new, unique, practical and useful.

What is claimed is:

1. An ellipsograph comprising:

(a) a base consisting of a pair of parallel rails having grooves formed in their inwardly facing sides, and a plate bridging said rails, said plate being attached to an upper surface of said rails and extending from one end of said rails to approximately the mid-point of said rails;

(b) a support plate slidably mounted in a lower groove in said rails, said support plate having a U-bracket partially surrounding one of said rails;

(c) a slide plate slidably mounted in an upper groove of said rails, said slide plate having a transverse groove formed near one end and a first circular opening formed near the opposite end;

(d) a motor having a shaft bearing a gear, said motor being mounted upon the surface of said bridging portion of said base, adjacent to the end of said base;

(e) a battery case mounted upon said base and connected to said motor by conductive wires, at least one of which is connected to a switch;

(f) a second circular opening formed in a portion of said bridging portion of said base;

(g) a puller disc fitted into said second circular opening having gear teeth at its circumference and a lateral slot formed along a diameter, said lateral slot having rails formed in the long sides;

(h) a puller carrier slidably fitted into said lateral slot engaging said rails;

(i) an adjusting screw rod threaded through said puller carrier and rotatably engaged into the end walls of said lateral slot, having a knurled knob thumb wheel affixed to one end;

(j) a puller rod mounted in said puller carrier projecting below said base and slidably engaging said transverse groove in said slide plate;

(k) a pen carrier disc mounted in said first circular opening having gear teeth at its circumference and a lateral slot formed along a diameter, said lateral slot having rails formed in the long sides of said lateral slot;

(l) a pen carrier slidably fitted into said lateral slot of said pen carrier disc and engaging said rails;

(m) an adjusting screw rod threaded through said pen carrier and rotatably engaged into the end walls of said lateral slot, having a knurled knob thumb wheel affixed to one end;

(n) a pen holder mounted in said pen carrier, adapted to hold a pen projecting below said pen carrier disc; and (o) a transmission rod rotatably and slidably mounted through fasteners on said bridging portion of said base and on said slide plate, said transmission rod carrying a gear for engagement with said bevel gear attached to said motor shaft and worm gears engaging said gear teeth on the circumference of said puller disc and said pen carrier disc.

2. The ellipsograph of claim 1 wherein a micro-adjusting control is provided in said puller carrier and in said pen carrier engaging said adjusting screw rods.

3. The ellipsograph of claim 1 having a drawing control unit comprising:

(a) a base platform separably engaged to said base of said ellipsograph;

(b) a reversible motor mounted on said base driving a shaft having a worm gear and terminating in a ratchet gear;

(c) a lower switch control disc having gear teeth on at least a portion of its circumference for engagement with said worm gear, having a central pivot projecting from its bottom surface, a central opening in its upper surface and a vertical stub near the perimeter;

(d) an upper switch control disc, having a smaller diameter than said lower switch control disc, having a vertical stub near its perimeter and a central arbor for engagement with the central opening of said lower switch control disc;

(e) a control switch device having a lever mounted upon said base and engagable alternatively with one of said vertical stubs on said switch control discs, said switch control device determining the direction of rotation of said motor;

(f) a drive system for connecting said reversible motor to said transmission rod comprising a ratchet gear, a spring, bevel gears and a coupling shaft;

(g) a pen position control comprising a drawing control gear having gear teeth on at least a portion of its circumference for engagement to said worm gear of said motor shaft and a vertical stub mounted at the periphery, a positioning control disc mounted adjacent to said drawing control gear having regular indentations on its upper surface, a rotary disc rotatably mounted above said position and control disc and having at least one spring-loaded ball engagably alternatively with the indentations of said positioning control disc, at least one cam disc mounted above and rotating with said rotary disc, a ratchet ear mounted above and rotating with said cam disc, a pivoted linkage connecting said drawing control gear to said ratchet gear for advancing said ratchet gear in stepwise fashion, and a lever puller being a lever pivoted at its middle, having one end of said lever in contact with said cam disc and the opposite end attached to a cable; and (h) means for raising and lowering the drawing pen in response to movement of said cable.

4. The ellipsograph of claim 3 wherein the means for raising and lowering said drawing pen consists of a pair of rings having a circular cross-section and matching faces cut at an angle, a lug projecting from the surface of each ring in an overlapping relationship to each other, a cable passing through both of said lugs and abutting the surface of the second lug, a spring wound around said cable and landing on the opposite surfaces of said lugs and a cylindrical pen holder inserted through said rings.

* * * * *